United States Patent [19]

Bedell

[11] Patent Number: 4,506,725

[45] Date of Patent: Mar. 26, 1985

[54] METHOD AND APPARATUS FOR MAGNETICALLY HOLDING A CAST METAL RIBBON AGAINST A BELT

[75] Inventor: John R. Bedell, Madison, N.J.

[73] Assignee: Electric Power Research Institute, Palo Alto, Calif.

[21] Appl. No.: 439,630

[22] Filed: Nov. 5, 1982

[51] Int. Cl.[3] ..... B22D 11/06; B22D 27/02

[52] U.S. Cl. ..... 164/463; 164/423; 164/481; 164/432; 164/466; 164/502

[58] Field of Search ..... 164/423, 463, 481, 482, 164/431–434, 466, 502

[56] References Cited

U.S. PATENT DOCUMENTS 2,682,334 6/1954 Thompson .
2,995,363 8/1961 Pittwood .
3,426,836 2/1969 Altenpohl et al. ..... 164/481 X
3,973,770 8/1976 Montenbruck .
4,301,855 11/1981 Suzuki et al. ..... 164/423 X

*Primary Examiner*—Kuang Y. Lin
*Attorney, Agent, or Firm*—King, Liles and Schickli

[57] ABSTRACT

A continuous casting assembly has a pair of counter-rotating belts for controllably forming a continuous elongated cast ribbon. One of the belts is a chilled substrate for receiving molten metal discharged from a dispensing nozzle. The other belt is positioned immediately adjacent the chilled substrate belt and contactable. Both of the belts are moved in a substantially parallel paths at the same predetermined speed with the cast ribbon interposed between the belts. Magnetic forces are used to urge the two belts together in contacting relationship with each other and with the interposed cast ribbon.

14 Claims, 2 Drawing Figures

METHOD AND APPARATUS FOR MAGNETICALLY HOLDING A CAST METAL RIBBON AGAINST A BELT

TECHNICAL FIELD

The invention relates generally to casting continuous metal ribbons by depositing molten metal onto a moving chilled substrate. In particular, the invention relates to magnetically holding a cast metal ribbon between a chilled belt member and a further belt member for improved quality of and control over the cast metal ribbon and enhanced heat transfer between the ribbon and belt members.

BACKGROUND OF THE INVENTION

In the process of continuously casting metal strips, such as ribbons, it is common practice to dispense molten metal through a nozzle onto a moving chilled substrate. The molten metal solidifies soon after contact with the chilled surface. A cast product having an amorphorous molecular structure, and in the form of a relatively thin elongated strip or ribbon, has proven to be effective for winding into highly efficient cores for electrical transformers, and for other uses. Recent developments in the casting of amorphorous metal strips are reviewed in U.S. Pat. No. 4,142,571.

It is known in the prior art to cast conventional metal alloys between a pair of opposed counter-rotating belts. In U.S. Pat. No. 3,426,836, for example, molten metal is deposited in a liquid state between a pair of upper and lower moving belts and a pair of lateral belts cooperatively forming a moving mold cavity. The molten metal is chilled in the mold cavity for solidification as it is moved with the cavity formed by the moving belts. Pressure is applied against the top and bottom belts to urge these belts against opposite sides of the interposed cast metal, the pressure being applied by either pressure rollers or a pressurized fluid, such as compressed air. The applied pressure is designed to compensate for shrinkage of the cast metal upon solidification. A further example of cooling molten metal between a pair of counter-rotating belts is shown and described in U.S. Pat. No. 2,285,740.

In U.S. Pat. No. 4,202,404, an apparatus for producing continuous metal strips on the peripheral surface of a rapidly rotating annular chill roll is disclosed. In this last mentioned patent, once the metal strip is deposited upon the chill roll, an elastomeric flexible belt frictionally engages an arcuate portion of at least 120° about the chill roll with the deposited metal strip positioned between the belt and the chill roll. The belt is wider than the cast strip so that it overlaps the marginal portions of the strip, and direct contact between the casting surface and the flexible belt is established immediately adjacent the portions of the strip. Flexible belts which engage the casting surface in this manner are known in the art as "hugger" belts.

DISCLOSURE OF THE INVENTION

Accordingly, it is a primary object of the invention to provide a pair of contiguously counter-rotating endless belts magnetically attracted together for cooling of cast amorphorous metal ribbons and the like by sandwiching the ribbon between the belts.

Another object of the invention is to a method for cooling of the ribbon between magnetically attracted belts to enhance the quenching of the ribbon and thereby to improve the finish and shape, and to accurately control the position of the ribbon for delivering it to other systems.

The present invention thus advances the teachings of the prior art by providing a casting system which magnetically forces a hugger belt into contacting relationship with a casting surface belt and an interposed cast ribbon. Magnetically urging the two belts into contacting relationship enhances the heat transfer between the ribbon and the belts and leads to improved quality of the ribbon finish and shape. Further, the magnetic confinement of the cast ribbon between the casting and hugger belts permits better control of the ribbon location for delivery to other processing equipment.

In one aspect of the invention, it is contemplated that one of the belts will be formed of paramagnetic or non-magnetic material with the other belt formed of ferromagnetic material. Magnets are aligned on the interior surface of the paramagnetic or non-magnetic belt, and these magnets attract the ferromagnetic belt, forcing the belts into contacting relationship.

Still other objects of the invention and advances in the teachings of the prior art by the present invention will become readily apparent to those skilled in this art from the following description. There is shown and described a preferred embodiment of the invention, simply by way of illustration of one of the best modes and an alternative embodiment contemplated for carrying out the invention. As will be realized, the invention is capable of other different embodiments, and its several details are capable of modification in various, obvious respects all without departing from the invention. Accordingly, the drawings and descriptions that follow will be regarded as illustrative in nature and not as restrictive.

BRIEF DESCRIPTION OF THE DRAWINGS

The accompanying drawings incorporated in and forming a part of this specification, illustrate several aspects of the present invention, and together with the description serve to explain the principles of the invention. In the drawings.

Reference will now be made in detail to the present preferred embodiments of the invention, examples of which are illustrated in the accompanying drawings.

BEST MODE OF CARRYING OUT THE INVENTION

Figure 1:
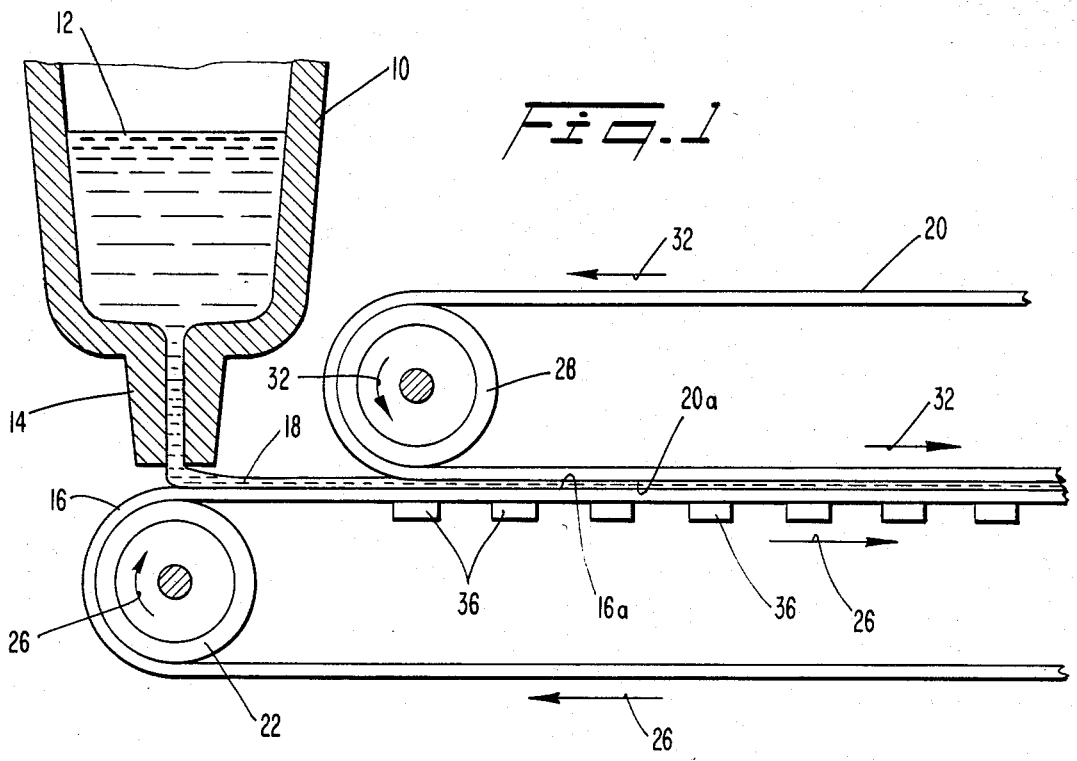
FIG. 1 is a schematic depiction of a dispensing nozzle depositing a molten amorphorous metal ribbon on a chilled endless belt substrate with a contiguous counter-rotating hugger belt positioned intimately above.

Reference is first made to FIG. 1 which schematically depicts a crucible 10 filled with a molten metal alloy 12, which if properly cast forms an amorporous metal strip. The molten metal 12 is delivered from the crucible 10 to a nozzle 14 positioned intimately above a moving chilled substrate 16. The specific illustrated chilled substrate of the preferred embodiments takes the form of an endless belt 16. After being discharged from the nozzle 14 and deposited onto the endless belt 16, the molten metal 12 quickly begins to solidify to form a continuous elongated strip or ribbon 18.

A second endless belt 20 is continuously positioned closely above the chilled substrate belt 16. The second endless belt 20 is counter-rotating with respect to the chilled substrate belt 16 and is termed a "hugger" belt since, as will be described more fully below, this belt 20 contacts or "hugs" the substrate belt 16 to sandwich the interposed cast ribbon 18 between the two belts 16 and 20.

The substrate belt 16 spans the distance between two end rollers 22 (only one of which is illustrated) and, as indicated by arrows 26, moves in a clockwise direction as viewed in FIG. 1. The end rollers 22 define an upper working surface 16*a* extending across the expanse defined by these rollers 22. The upper working surface 16*a* moves in a substantially horizontal direction at a predetermined speed.

The second or hugger belt 20 extends between end rollers 28 (only one of which is illustrated) to define a lower working surface 20*a* therebetween. As indicated by arrows 32, the hugger belt 20 moves in a counter-clockwise direction as viewed in FIG. 1 and is thus counter-rotating with respect to the chilled substrate belt 16. The lower working surface 20*a* of hugger belt 20 moves horizontally in substantially parallel relationship to the chilled substrate belt 16 at the same predetermined speed.

Figure 2:
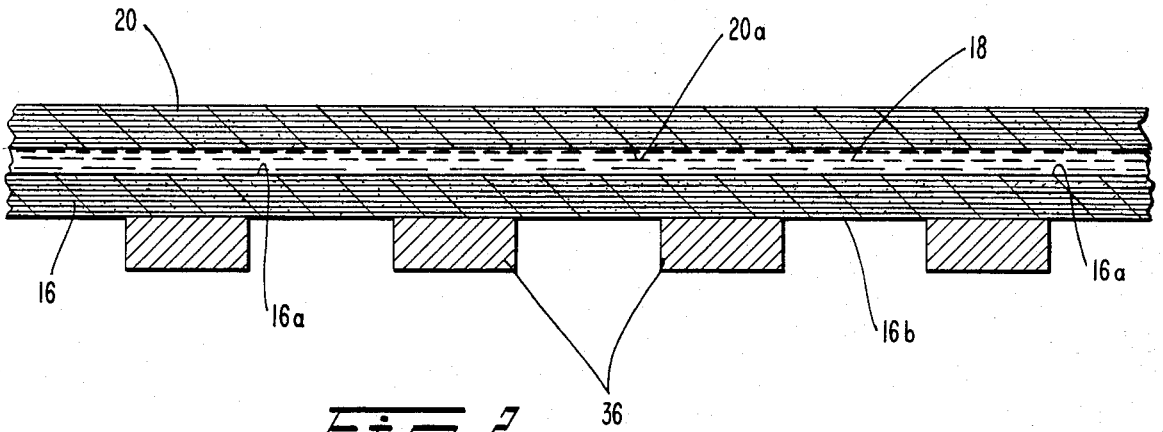
FIG. 2 is an enlarged fragmentary sectional view of the chilled substrate and hugger belts of FIG. 1 taken along the direction of belt travel and depicting a first embodiment of the invention with a series of stationary magnets affixed underneath.

Turning now to FIG. 2, enlarged fragmentary sections of the working surfaces 16*a* and 20*a* of the chilled substrate and hugger belts 16 and 20 respectively are shown. The ribbon 18 is interposed between these two working surfaces 16*a* and 20*a* in contacting relationship with each. In the embodiment of FIG. 2, the hugger belt 20 is formed of ferromagnetic material and is sufficiently flexible for the working surface 20*a* to be drawn downwardly toward the chilled substrate belt 16.

The chilled substrate belt 16 of FIG. 2 is formed of a highly heat conductive, flexible paramagnetic or non-magnetic material, such as a copper alloy. The interior surface 16*b* of this belt slides across a series of aligned magnets 36 affixed underneath. These magnets 36, which may be stationarily mounted in any conventional manner (not shown), attract the hugger belt 20 and bring the working surface 20*a* of the hugger belt 20 into contact with both. the ribbon 18 and the chilled substrate belt 20. Forcing the hugger belt 20 against the substrate belt 16 with the ribbon 18 interposed therebetween leads to better confinement and control of the ribbon 18. The ribbon 18 cast with this hugger belt thus has a higher quality finish and is more uniform in thickness. Forcing the hugger belt against both the ribbon 18 and the chilled substrate belt 16 also enhances heat transfer for more efficient cooling and solidification of the metal.

It is possible to cast a ribbon 18 of ferromagnetic material and to attract the ribbon 18 against the paramagnetic belt 16 by judicious placement of magnets behind the belt 16 without the employment of a second or hugger belt 20. However, the thinness of the ribbon 18 cast in the preferred embodiment imposes significant limitations in such an application. The maximum magnetic attraction force is limited by the magnetic saturation and mass of the material involved. The magnetic saturation is, in turn, a function of material type. Since the cast material contemplated by the invention is relatively thin, the magnetic attraction force is relatively low. The hugger belt 20 of the invention is substantially thicker than the ribbon 18 and is much less limited by its magnetic saturation and mass. The hugger belt 20 of the FIG. 2 embodiment is preferably formed of a ferromagnetic material with good wear and corrosion resistance. In the preferred embodiment, a 400 series stainless steel is used. As should be apparent from the discussion above, the use of a hugger belt 20 permits the casting of a relatively thin ribbon 18.

It should also be apparent that it is possible to construct the hugger belt 20 of paramagnetic material and to align the magnets adjacent the interior surface of that hugger belt. If this latter arrangement were used, the chilled substrate belt 20 would be formed of ferromagnetic material, and the substrate belt 20 would be urged upwardly by the magnetic attraction provided by the magnets on the interior surface of the hugger belt.

Further, the magnetic belt(s) may be formed of flexible magnetic material and having the other required properties of heat conductivity, flexibility and the like. As a still further alternative, permanent magnets may be attached to the underside of the substrate belt 16, or actually formed in the belt 16, to provide the attracting force for the hugger belt 20. In this instance, the magnets are also preferably flexible magnetic material to allow the belts to move around the rollers 22, 32.

In summary, numerous benefits have been described which result from employing the concepts of the present invention. The invention contemplates the magnetic attraction of endless chilled substrate and hugger belts 16, 20 with a cast metal ribbon 18 controllably sandwiched therebetween in enhanced heat transfer relationship with the belts. In a preferred form of the invention, one of the belts, belt 16, is formed of paramagnetic or non-magnetic material with magnets positioned beneath its interior surface (see FIG. 2). The other belt 20 is formed of ferromagnetic material and is attracted to the magnets resulting in squeezing of the ribbon.

The foregoing description of preferred embodiments of the invention has been presented for purposes of illustration and description. It is not intended to be exhaustive or to limit the invention to the precise form disclosed. Obvious modifications or variations are possible in light of the above teachings. The embodiments were chosen and described in order to illustrate the principles of the invention and its practical application to enable one of ordinary skill in the art to utilize the invention and the various embodiments and with various modifications as are best suited to the particular use contemplated. It is intended that the scope of the invention be defined by the claims appended hereto.

I claim:

1. A method of casting molten metal, comprising:

(a) moving a first belt at a predetermined speed to form a chilled substrate for receiving molten metal deposits;

(b) depositing a molten metal ribbon on a surface of the first belt;

(c) moving a second belt adjacent the first belt at substantially the same speed as the first belt in substantially parallel relationship thereto; and (d) magnetically urging at least one of said belts toward the other and bringing the surface of the second belt into squeezing relationship with the corresponding surface of the first belt to sandwich the ribbon between the belts while moving at the predetermined speed.

2. A method as recited in claim 1 wherein one of said belts is formed of magnetic material and the other belt has at least one magnet disposed adjacent its surface opposite the surface in contacting relationship with the ribbon.

3. A method as recited in claim 2 wherein a plurality of magnets are aligned adjacent to said other belt.

4. A method as recited in claim 3 wherein the other belt adjacent which the magnets are aligned is formed of a paramagnetic material and the said one belt is formed of ferromagnetic material.

5. A method as recited in claim 4 wherein the ferromagnetic belt is substantially thicker than the ribbon.

6. In an assembly for casting continuous metal ribbon, an apparatus for controllably cooling the ribbon, comprising:

(a) a continuously moving chilled belt traveling at a predetermined speed, including a working surface forming a substrate for receiving molten metal;

(b) means for depositing a molten metal ribbon onto the working surface of the chilled belt;

(c) a hugger belt disposed adjacent the working surface of the chilled belt, said hugger belt including a working surface traveling in substantially parallel relationship to said working surface of said chilled belt at said predetermined speed; and (d) means for magnetically urging the working surfaces of the chilled and hugger belts into squeezing relationship with each other and sandwiching the ribbon therebetween to control the ribbon and enhance the heat transfer relationship between the ribbon and the belts.

7. An apparatus as recited in claim 6 wherein both said chilled and hugger belts are endless with interior and exterior surfaces, the working surfaces of each of the belts being exterior surfaces.

8. An apparatus as recited in claim 7 wherein a plurality of magnets are disposed in aligned arrangement adjacent the interior surface of one of the belts, and the other belt is formed of a ferromagnetic material.

9. An apparatus as recited in claim 8 wherein the plurality of magnets are aligned on the interior surface of the chilled belt to magnetically urge the hugger belt into contacting relationship to the chilled belt and the interposed cast ribbon.

10. An apparatus as recited in claim 8, wherein the hugger belt has a magnetic saturation level which is sufficient to provide a magnetic attraction force to bring the hugger belt into contact with the chilled belt so as to squeeze the interposed ribbon.

11. An apparatus as recited in claim 10 wherein the hugger belt is a sufficient thickness to provide the magnetic saturation level for bringing the belts into squeezing relation for improved heat transfer between the ribbon and the belts.

12. An apparatus as recited in claim 11 wherein the hugger belt is formed of steel.

13. An apparatus as recited in claim 12 wherein the steel of the hugger belt is magnetic stainless steel.

14. An apparatus as recited in claim 13 wherein the chilled belt is formed of paramagnetic material.

* * * * *